United States Patent [19]

Woods

[11] 4,018,433

[45] Apr. 19, 1977

[54] SHEET MATERIAL TRANSPORTING MACHINE

[76] Inventor: Kenneth D. Woods, P.O. Box 141, Spring Valley, Calif. 92077

[22] Filed: Aug. 8, 1975

[21] Appl. No.: 603,096

[52] U.S. Cl. ..... 271/80; 271/272

[51] Int. Cl.[2] ..... B65H 29/20

[58] Field of Search ..... 271/80, 264, 272; 198/229

[56] References Cited

UNITED STATES PATENTS

| | | | |
|---|---|---|---|
| 650,579 | 5/1900 | Cole | 271/80 |
| 1,242,343 | 10/1917 | Gillespie | 271/264 |
| 1,974,128 | 9/1934 | Thompson | 198/229 |
| 2,531,253 | 11/1950 | Carden, Jr. | 271/80 |

*Primary Examiner*—Robert W. Saifer

[57] ABSTRACT

The invention consists of an attachment for a sheet material transporting system such as the ejector system of an off-set printing press, wherein the ejector system includes a rotating ejector drum, an idler wheel in frictional engagement with said drum adjacent each end thereof and being supported by a shaft rotatably disposed axially paralled to said drum and being rotatably driven by said idler wheels. Said attachment consists of a frame composed of paralled spaced frame members and an idler wheel rotatably disposed between said frame members at each end thereof. One of said idler wheels is coaxially disposed on said shaft and is rotated thereby. Said frame includes means for attaching said attachment to the off-set press for lateral adjustment to permit the idler wheels to contact the sheet material being ejected adjacent the edge thereof.

1 Claim, 2 Drawing Figures

SHEET MATERIAL TRANSPORTING MACHINE

The invention relates to an improvement in means for transporting relatively thin, flexible, sheet material and is more particularly adapted to the improvement of the sheet paper ejection system for such machines as offset printing presses. More specifically the invention comprises an attachment to be used in connection with the pull-out rollers of the paper ejection system to stabilize the position of the rollers and to result in the more efficient ejection of printed paper sheets.

Offset printing presses are normally provided with means for ejecting the sheet stock after the printing operation. The system includes a pull-out drum and an ejector roller with idler rollers riding on top of the pull-out drum and the ejector roller. The idler rollers are normally held in position by a carriage which can be laterally adjusted to compensate for varying widths of paper stock.

Such arrangement has heretofore proven unsatisfactory in that lateral adjustment of the idler rollers was difficult and could only be accomplished with the printing press at rest position. In other words, the adjustment could not be made with the machine running. This clearly resulted in the substantial loss of time.

Also the carriage holding the idler rollers tended to wobble from side to side, thereby either requiring a large marginal gap between the edge of the paper and the printing to accommodate the rollers or permitting the rollers to run off the edge of the paper.

A further difficulty with the existing ejection system resided in the fact that the idler wheels tended to pick up water thereby leaving water marks on the paper.

Further difficulties have been experienced with the present system in that any tendency of the paper to wobble from side to side due to instability of the idling roller assembly on each side had a tendency to cause the paper to drag across the surface of the preceding printed sheet and also to stack improperly.

With these defects and disadvantages in mind, I have designed an attachment for the ejection system of offset printing presses, which eliminates any wobble or sideways drifting of the idler wheels thereby providing a positive ejection and permitting the setting of the idler wheels as close to the edge of the paper as desired, or if required by the particular job or sheet stock, will permit setting of the wheels to run along the side of the sheet just touching the edge.

Also a further advantage of my invention lies in the fact that the operator may adjust the position of the wheels while the machine is running and by use of a simple thumb screw requiring no tools.

By being able to position the idler wheels laterally while the machine is being run a more accurate setting and a substantial saving of time results. Also the elimination of the need for tools, eliminates the possibility of dropping tools into the machinery.

I conceive as a further advantage of my invention, the fact that while it is being adjusted, it can be set at the option of the operator to apply a downward pressure on the idler roller assembly so that difficult stocks, or paper while being scored or perforated can be directed in proper alignment for the scoring or perforating operation and for direction into the paper receiver.

The attachment is also provided with a further advantageous feature in that it includes means for wiping water from the idler rollers to prevent undesired water marks.

These advantages and others will be more readily apparent from the drawings and specifications descriptive thereof.

Figure 1:
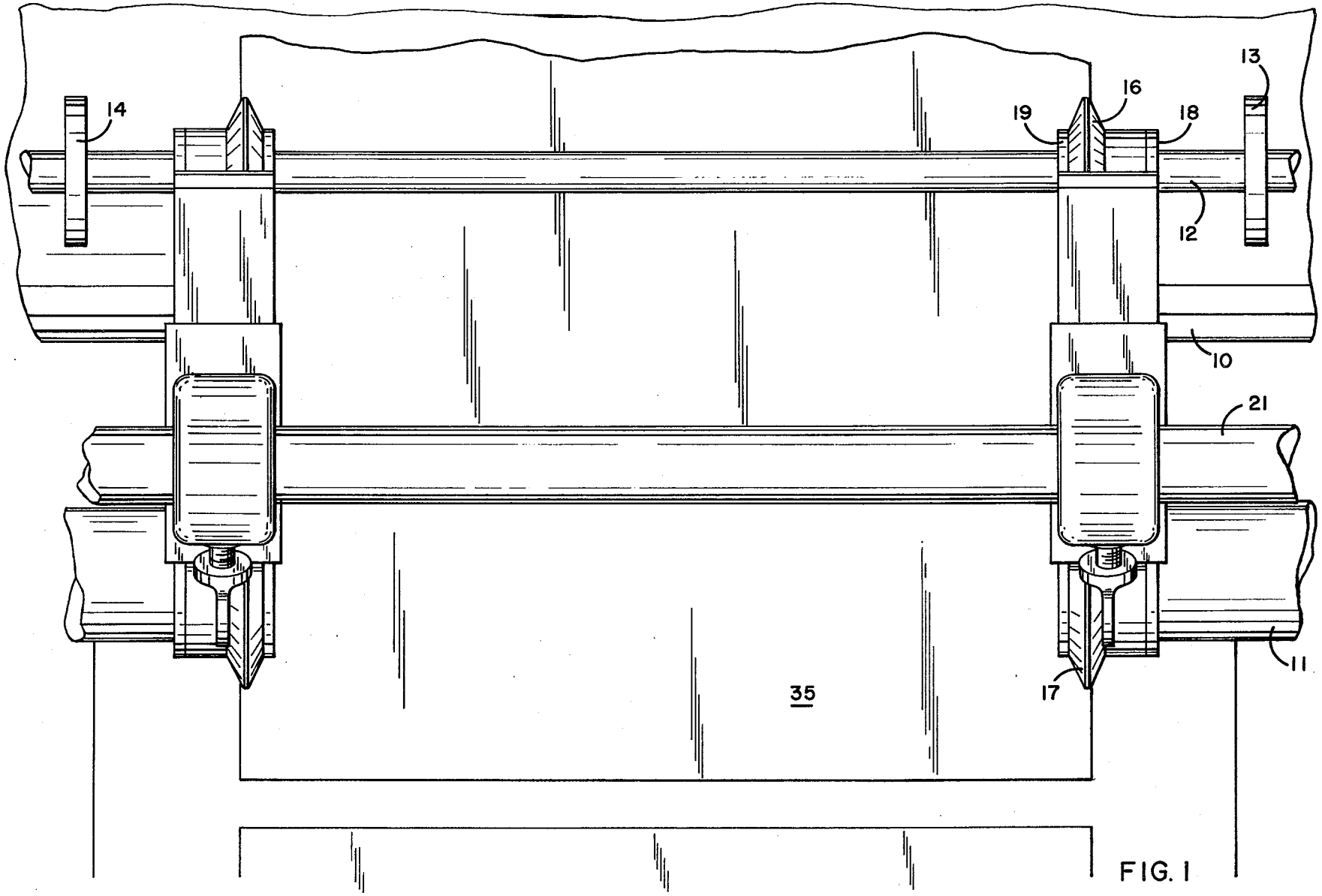
FIG. 1 is a top plan view of a portion of the ejector system of an offset printing machine showing my invention in top plan view.

I have illustrated a fragmentary portion of the ejector system of an offset printing press which includes a pull-out roller 10 and an ejector roller 11.

The system also includes a shaft 12 having secured thereto in non-rotatable relation, a pair of drive wheels 13 and 14 normally adapted to frictionally engage the drum 10 and to act as drive wheels to rotate shaft 12.

A pair of idler wheel assemblies designated generally 15 are disposed adjacent each edge of shaft 12 for slidable engagement therewith. Each carriage includes a pull-out idler wheel 16 and an ejector idler wheel 17. The wheels are held in the frame assembly by means of parallel frame members 18 and 19.

The drive wheels 13 and 14 are larger in diameter than the wheels 16 by the thickness of the paper being fed through the machine and ride on the surface of the drum 10. The wheels 13 and 14 provide a double function of driving the shaft 12 and preventing the wheels 16 from dropping into the slot (not shown) containing paper grippers (also not shown).

The idler wheel 17 is secured between the frame members 18 by means of a shaft 20 and rests on ejection roller 11. Most offset printing machines are provided with a bar such as 21 which extends from side to side as a part of the frame and is positioned above the drum 10 and the roller 11.

I have provided an attachment for use in connection with the ejection system above described which includes a means for attaching the device to the machine, including a clamp member 30 having a thumb screw such as 31. The clamp member is adapted to be disposed over the frame member 21 and to be secured in lateral and rotational position by means of the thumb screw 31.

The attachment also includes a top plate 32 having downwardly depending side plates 33 and 34. The top plate and the depending sides form an inverted channel member the sides of which are adapted to frictionally engage the frame members 18 and 19 to thereby hold them in rigid alignment.

It will therefore be readily seen that by loosening the thumb screw 31 and moving the clamping member 30 laterally on the frame member 21 that the idler roller assembly 15 may be laterally positioned adjacent to the edge of a sheet of paper such as 35 and further that both idling wheels 16 and 17 will remain in proper alignment.

In order to remove unwanted water or other contaminants from the idling roller 16, I have provided an absorbent wiping pad 35 secured to a resilient tongue 36 which is secured against the underside of plate 32 by frictional engagement between the side plates 33 and 34.

Figure 2:
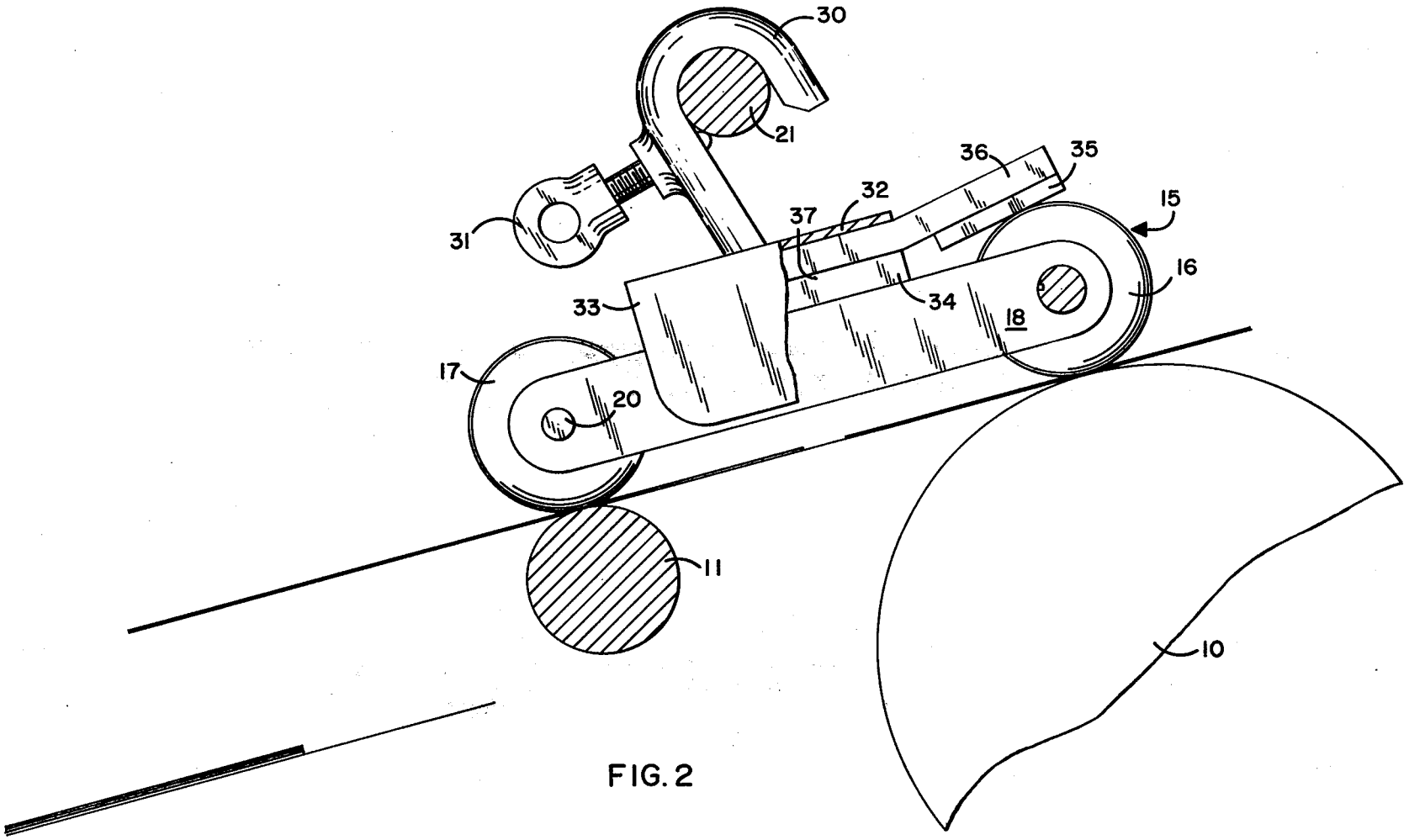
FIG. 2 is a side elevation of portions of the ejector system and showing my invention in side elevation partially broken away.

A further resilient pad 37 is secured by frictional engagement between the plates 33 and 34 and is adapted to press against the frame members 18 and 19 so that by rotation of the clamping member on shaft 21 in a clockwise direction as viewed in FIG. 2, additional pressure will be exerted by ejection wheel 17 against the roller 11.

Thus it will be seen that I have provided an attachment for an ejection system of sheet product handling machines such as offset printing machines which provides for positive wheel alignment, positive and true tracking of all pull-out rollers, a simple and efficient lateral adjusting means, a simple and positive pressure control means, means for eliminating wheel marks on the paper and a means for adjusting all of the above functions without shutting down the machine.

Whereas the device was originally designed for and finds its greatest use in connection with an offset printing machine, it is understood that it may be used in any device having a similar sheet ejection system, which requires accurate ejection of the sheet product.

The drawings and specifications description thereof are for illustrative purposes and are not intended to limit the scope of the invention, the only limitation being in the appended claims.

I claim:

1. An attachment for sheet material transporting machines of the type having a power driven drum, a rotatable shaft in spaced relation to said drum and axially parallel thereto, an idler roller positioned adjacent each end of said drum in frictional engagement therewith and adapted to cause rotation of said parallel shaft, an ejection roller in spaced axially paralled relation to said drum, and a frame member disposed paralled to said drum, said attachment comprising: a pair of parallel frame members in spaced relation, each of said frame members being formed with an aperture at each end thereof; a guide roller disposed between each end of said frame member and formed with an axial bore for axial registry with the apertures of said frame members, one end of each said frame member and one of said guide rollers being in axial allignment to receive said rotatable shaft therethrough whereby said guide roller is laterally positionable on said shaft and is adapted to bear against sheet material being transported therethrough, said second guide roller being formed with an axial bore for rotatable disposition between the other ends of said frame members and adapted to bear against the said ejector roller; and a U-shaped mounting member having means for securing said attachment to said frame member in laterally adjustable relation and including a pair of downwardly extending side members adapted to frictionally engage and support said frame members therebetween.

* * * * *